US009011109B2

(12) United States Patent
Ishikawa et al.

(10) Patent No.: US 9,011,109 B2
(45) Date of Patent: Apr. 21, 2015

(54) VARIABLE CAPACITY COMPRESSOR

(75) Inventors: Tsutomu Ishikawa, Isesaki (JP); Satoshi Terauchi, Isesaki (JP)

(73) Assignee: Sanden Corporation, Gunma (JP)

( * ) Notice: Subject to any disclaimer, the term of this patent is extended or adjusted under 35 U.S.C. 154(b) by 306 days.

(21) Appl. No.: 13/805,818

(22) PCT Filed: May 31, 2011

(86) PCT No.: PCT/JP2011/062539

§ 371 (c)(1),
(2), (4) Date: Dec. 20, 2012

(87) PCT Pub. No.: WO2011/162077

PCT Pub. Date: Dec. 29, 2011

(65) Prior Publication Data

US 2013/0089445 A1 Apr. 11, 2013

(30) Foreign Application Priority Data

Jun. 21, 2010 (JP) ..... 2010-140168

(51) Int. Cl.

| | |
|---|---|
| ***F04B 39/02*** | (2006.01) |
| ***F04B 1/14*** | (2006.01) |
| ***F04B 41/00*** | (2006.01) |
| ***F04B 27/10*** | (2006.01) |
| ***F04B 39/04*** | (2006.01) |

(52) U.S. Cl.

CPC ..... *F04B 41/00* (2013.01); *F04B 27/109* (2013.01); *F04B 39/0238* (2013.01); *F04B 39/04* (2013.01)

(58) Field of Classification Search

CPC ..... F04B 39/04; F04B 27/109; F04B 53/18; F04B 41/00; F04B 39/0238

USPC ..... 91/505; 417/222.2

See application file for complete search history.

(56) References Cited

U.S. PATENT DOCUMENTS

| | | | | |
|---|---|---|---|---|
| 5,823,294 | A | 10/1998 | Mizutani et al. | |
| 6,149,398 | A * | 11/2000 | Fukanuma et al. | 417/222.2 |
| 6,174,140 | B1 | 1/2001 | Ota et al. | |
| 6,217,293 | B1 | 4/2001 | Murase et al. | |
| 6,511,297 | B2 * | 1/2003 | Ota et al. | 417/222.2 |
| 6,558,133 | B2 * | 5/2003 | Fukanuma et al. | 417/222.2 |
| 7,114,434 | B2 * | 10/2006 | Kanai | 92/12.2 |
| 7,204,098 | B2 * | 4/2007 | Yamada et al. | 62/470 |
| 8,360,742 | B2 * | 1/2013 | Kimoto et al. | 417/222.2 |
| 2006/0245939 | A1 * | 11/2006 | Fukanuma et al. | 417/269 |
| 2009/0116971 | A1 | 5/2009 | Ozeki et al. | |

FOREIGN PATENT DOCUMENTS

| | | |
|---|---|---|
| CN | 1221073 | 6/1999 |
| EP | 1 857 676 | 11/2007 |
| JP | 11-257217 | 9/1999 |
| JP | 2000-45940 | 2/2000 |
| JP | 2005-194932 | 7/2005 |
| WO | WO 2007/111194 | 10/2007 |

* cited by examiner

*Primary Examiner* — Bryan Lettman
(74) *Attorney, Agent, or Firm* — Cozen O'Conner

(57) ABSTRACT

In a swash plate type variable capacity compressor that changes a stroke of a piston by controlling the pressure of a crank chamber (6), lubrication oil contained in refrigerant gas is maximally prevented from being circulated outside the compressor. Some of discharged refrigerant gas in a discharge chamber (22) flows into the crank chamber (6) through a communication passage (25) (25*a* and 25*b*) and a control valve (27), while some of the discharged refrigerant gas flows out to a suction chamber (21) from the crank chamber (6) through a second communication passage (26) and an orifice (28), and the pressure of the crank chamber (6) is controlled through a balance between an inflow amount and an outflow amount. Oil storage chamber (30) extends downstream of the control valve (27) on the first communication passage (25) to separate oil and store the separated oil. Oil return passage (31) returns the oil stored in the oil storage chamber (30) to the crank chamber (6).

5 Claims, 4 Drawing Sheets

VARIABLE CAPACITY COMPRESSOR

RELATED APPLICATIONS

This is a U.S. National Phase Application under 35 USC 371 of International Application PCT/JP2011/062539 filed on May 31, 2011.

This application claims the priority of Japanese application no. 2010-140168 filed Jun. 21, 2010, the entire content of which is hereby incorporated by reference.

TECHNICAL FIELD

The present invention relates to a variable capacity compressor that compresses refrigerant gas containing lubrication oil, and more particularly, to a technology that reduces lubrication oil that flows out from a compressor to a circuit.

BACKGROUND ART

In a swash plate type variable capacity compressor in the related art, an inclination angle of a swash plate is changed by controlling the pressure of a crank chamber in the rear of a piston to change a stroke (discharge capacity) of the piston. In detail, when the pressure of the crank chamber is decreased, the inclination angle of the swash plate is increased, and as a result, the discharge capacity of the compressor is increased. In contrast, when the pressure of the crank chamber is increased, the inclination angle of the swash plate is decreased, and as a result, the discharge capacity of the compressor is decreased.

Furthermore, the variable capacity compressor includes a first communication passage that allows a discharge chamber and a crank chamber to communicate with each other, a second communication passage that allows the crank chamber and a suction chamber to communicate with each other, a control valve mounted on the first communication passage, and an orifice mounted on the second communication passage, and a balance between an inflow amount of high-pressure refrigerant gas that flows into the crank chamber through the first communication passage and an outflow amount of refrigerant gas that flows out from the crank chamber through the second communication passage is controlled by controlling an opening level of the first communication passage with the control valve to change the pressure of the crank chamber.

However, in the variable capacity compressor, each unit of the compressor is lubricated by mixing the lubrication oil in the refrigeration gas. As a result, the lubrication oil that flows out from the compressor to the circuit is reduced, that is, an oil circulation rate (OCR) is decreased to enhance system efficiency. Furthermore, the decrease of the OCR in a capacity control region is required in that the OCR is increased (deteriorates) in the capacity control region as compared with a maximum capacity operation.

As a result, in Patent Document 1, a centrifugal oil separator is provided on a discharge passage from the discharge chamber to separate oil and return the separated oil to the crank chamber.

Furthermore, in Patent Document 2, an oil separator (oil separation mechanism) is provided on the first communication passage (a passage of control gas from the discharge chamber to the crank chamber) to separate lubrication oil from the control gas and allow the separated lubrication oil to flow down to the crank chamber.

CITATION LIST

Patent Document

Patent Document 1: International Publication No. WO2007/111194

Patent Document 2: Japanese Laid-Open Patent Application Publication No. H11-257217

SUMMARY OF INVENTION

Technical Problem

However, in the technology disclosed in Patent Document 1, since the refrigerant gas discharged from the compressor flows to a circuit by passing through the oil separator, pressure loss occurs during the flow of the refrigerant gas, and as a result, efficiency deteriorates throughout an entire region.

In the technology disclosed in Patent Document 2, in the capacity control region in which the control gas flows on the first communication passage running from the discharge chamber to the crank chamber, the oil may be separated from the control gas, while since the oil separator is provided on a passage of the control gas, efficiency deterioration may be suppressed. However, since the separated oil is not stored but returned, oil is immediately misted before oil is sufficiently liquefied, and as a result, oil flows out to the suction chamber through the second communication passage running from the crank chamber to the suction chamber. Therefore, since a lubrication oil amount in the crank chamber is short, a lubrication failure of each unit occurs.

In view of the above conventional problems, an object of the present invention is to provide a lubrication structure of a variable capacity compressor that enables efficient OCR reduction in a capacity control region.

Solution to Problem

In order to solve the problem, a variable capacity compressor includes a piston which compresses refrigerant gas containing lubrication oil drawn from a suction chamber to discharge the compressed refrigerant gas to a discharge chamber, a crank chamber disposed in the rear of the piston, a first communication passage which allows the discharge chamber and the crank chamber to communicate with each other, a second communication passage which allows the crank chamber and the suction chamber to communicate with each other, a control valve mounted on the first communication passage, and an orifice mounted on the second communication passage, and changes a stroke of the piston by controlling the pressure of the crank chamber with the control valve, the variable capacity compressor including: an oil storage chamber extended at a downstream of the control valve on the first communication passage to separate oil and store the separated oil; and an oil return passage formed separately from the first communication passage running from the oil storage chamber to the crank chamber to return the oil stored in the oil storage chamber to the crank chamber.

Advantageous Effects of Invention

According to the present invention, in the capacity control region in which the control gas flows on the first communication passage running from the discharge chamber to the crank chamber, the oil may be separated from the control gas, while since an oil storage chamber (extension chamber) for oil separation is provided on a passage of the control gas, efficiency deterioration may be suppressed. Furthermore, since the oil storage chamber is provided to store the separated oil at least temporarily, liquefaction is promoted after separation, and as a result, a time when the lubrication oil remains in the crank chamber is increased, thereby enhancing lubricating performance of each unit.

DESCRIPTION OF EMBODIMENTS

Hereinafter, embodiments of the present invention will be described in detail.

Figure 1:
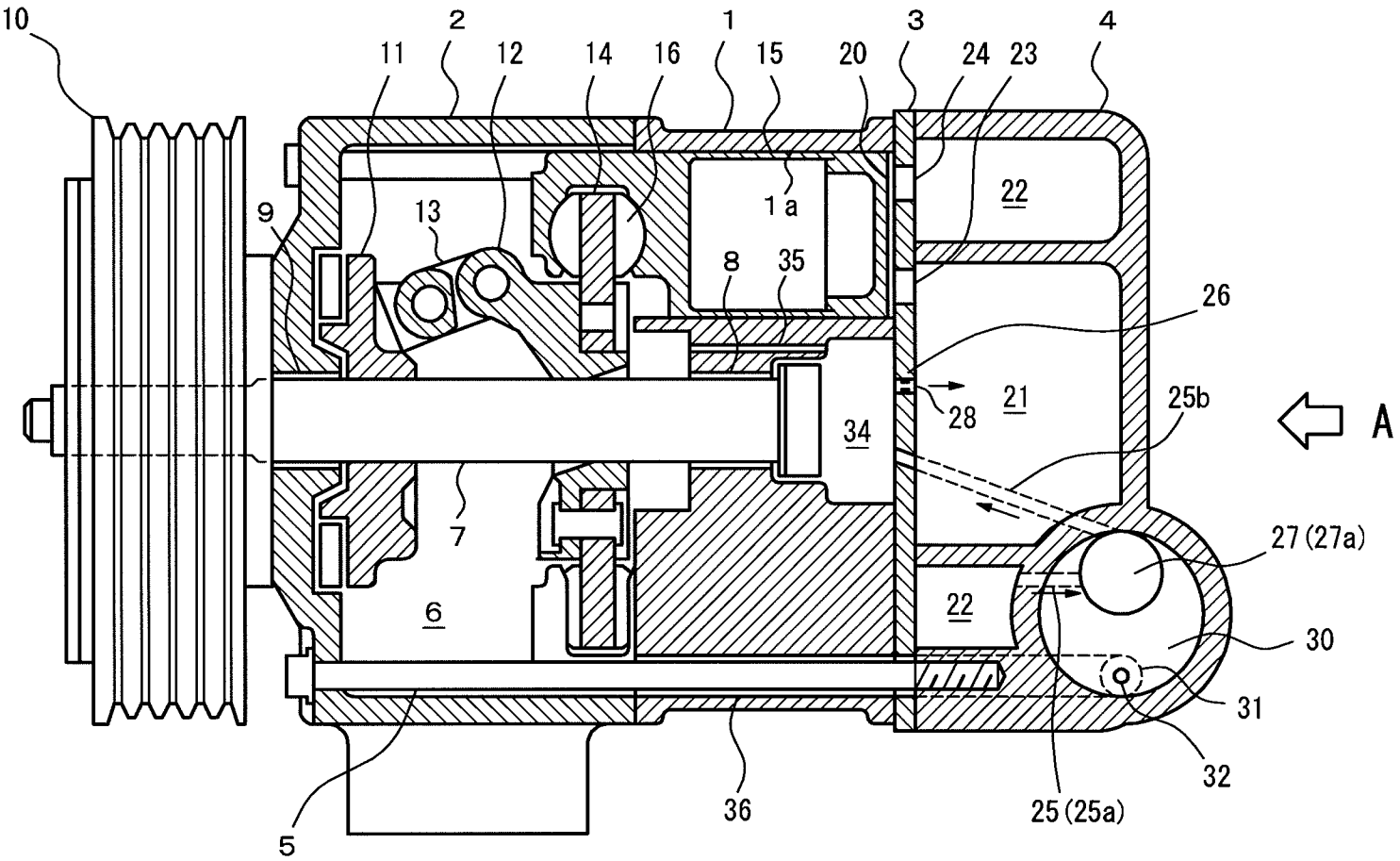
FIG. 1 is a longitudinal cross-sectional view of a variable capacity compressor illustrating an embodiment of the present invention.
Figure 2:
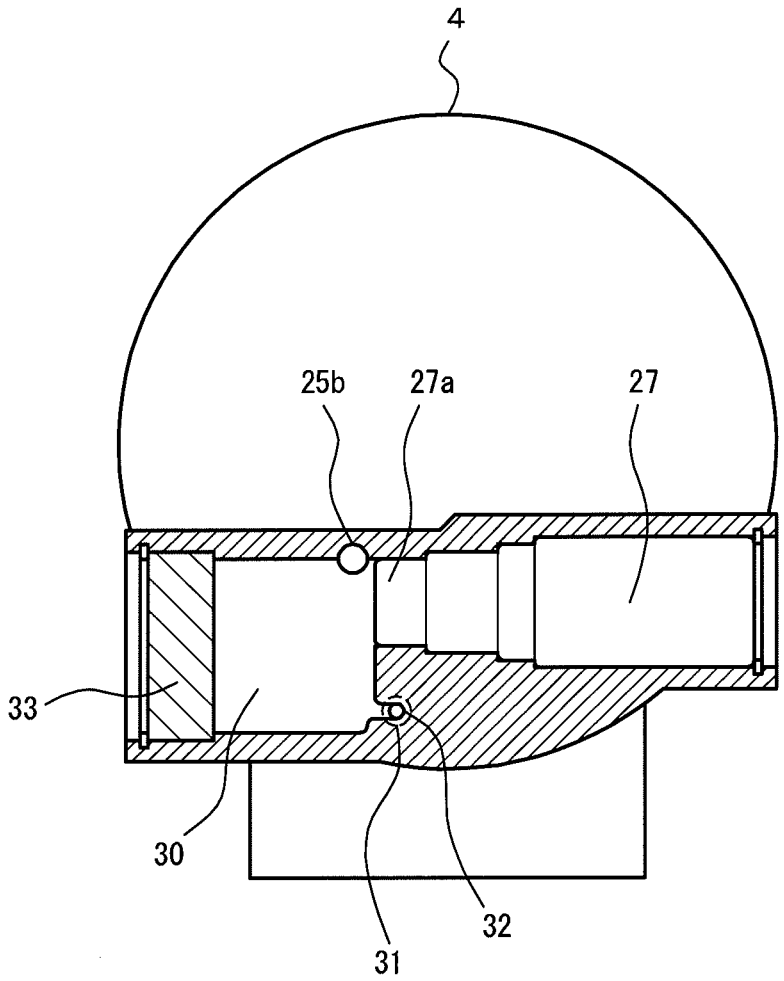
FIG. 2 is a diagram viewed by arrow A of FIG. 1.

FIG. 1 is a longitudinal cross-sectional view of a variable capacity compressor illustrating an embodiment of the present invention and FIG. 2 is a diagram viewed by arrow A of FIG. 1.

The variable capacity compressor includes a cylinder block 1 having a plurality of cylinder bores 1*a*, a front housing 2 provided at one end of the cylinder block 1, and a rear housing (cylinder head) 4 provided at the other end of the cylinder block 1 with a valve plate 3 (valve and port forming element) interposed therebetween, which are together fastened and fixed to each other by a bolt 5.

A drive shaft 7 is provided at the center of the cylinder block 1 and the front housing 2 by crossing a crank chamber 6 formed therebetween, and the drive shaft 7 is rotatably supported by bearings 8 and 9.

One end of the drive shaft 7 protrudes outward by penetrating the front housing 2, and a pulley 10 driven by an engine is mounted at a protruding end portion through an electromagnetic clutch (not illustrated).

A rotor 11 is fixed at one position in a middle portion of the drive shaft 7, and a swash plate supporting body 12 that slidably moves in an axial direction, and tiltably moves is attached at another position in the middle portion of the drive shaft 7. The rotor 11 rotates integrally with the drive shaft 7, and the rotor 11 and the swash plate supporting body 12 is connected to each other by a hinge mechanism 13. Therefore, the swash plate supporting body 12 rotates to interlock with the drive shaft 7 while slidably and tiltably moving in the axial direction with respect to the drive shaft 7. A swash plate 14 is fixedly supported onto the swash plate supporting body 12. Accordingly, the swash plate 14 rotates to interlock with the drive shaft 7 with being inclined to the drive shaft 7, and furthermore, an inclination angle of the swash plate 14 may be adjusted. Furthermore, the swash plate 14 has an inclination angle of 0° in the drawing, but the swash plate 14 is inclined from an initial state together with the swash plate supporting body 12 by a pair of initial setting springs (not illustrated) which are actuated before and behind the swash plate supporting body 12.

A plurality of cylinder bores 1*a* that is arranged at a regular interval on a circumference to surround the drive shaft 7 and extends in parallel to an axial line of the drive shaft 7 is formed at the cylinder block 1, and a single-head piston 15 is received in each cylinder bore 1*a* to be reciprocatingly moved.

A forked portion in a U-shape is formed at the end (a portion opposite to a head portion) of each piston 15, and the forked portion is anchored with an outer periphery of the swash plate 14 via a pair of shoes 16 disposed before and behind an outer periphery of. Therefore, a rotating motion of the swash plate 14 caused by rotation of the drive shaft 7 is converted into a reciprocating linear motion of the piston 15 with the shoe 16 interposed between the swash plate 14 and the piston 15.

A compression chamber 20 surrounded by the piston 15 and the valve plate 3 is partitioned at a head side of the piston 15 of the cylinder bore 1*a*.

In the rear housing 4, a suction chamber 21 is partitioned at an inner peripheral side, and a discharge chamber 22 is partitioned at an outer peripheral side.

A suction port 23 that allows the compression chamber 20 and the suction chamber 21 to communicate with each other and a discharge port 24 that allows the compression chamber 20 and the discharge chamber 22 to communicate with each other are formed on the valve plate 3, and one-way valves (not illustrated) are provided at the suction port 23 and the discharge port 24, respectively.

Therefore, the piston 15 moves left, and as a result, the volume of the compression chamber 20 is increased to draw the refrigerant from the suction chamber 21 in FIG. 1, and the piston 15 moves right, and as a result, the volume of the compression chamber 20 is decreased to compress the refrigerant in the compression chamber 20 and discharge the compressed refrigerant to the discharge chamber 22. Furthermore, the suction chamber 21 communicates with an outlet of an evaporator of a vapor compression type refrigerator, and the discharge chamber 22 communicates with an inlet of a condenser through a discharge cut-off valve (see FIG. 3).

Herein, the discharge capacity may be changed by changing a stroke of the piston 15 according to the inclination angle of the swash plate 14, and the inclination angle (the stroke of the piston 15) of the swash plate 14 is determined by the pressure of the crank chamber 6.

That is, the inclination angle of the swash plate 14 may be arbitrarily controlled by using a pressure difference before and behind each piston 15, that is, a pressure difference between the compression chamber 20 and the crank chamber 6 with the piston 15 interposed therebetween, and as a result, the pressure of the crank chamber 6 is controlled in the range of the pressure (suction pressure Ps) of the suction chamber 21 to the pressure (discharge pressure Pd) of the discharge chamber 22.

Figure 3:
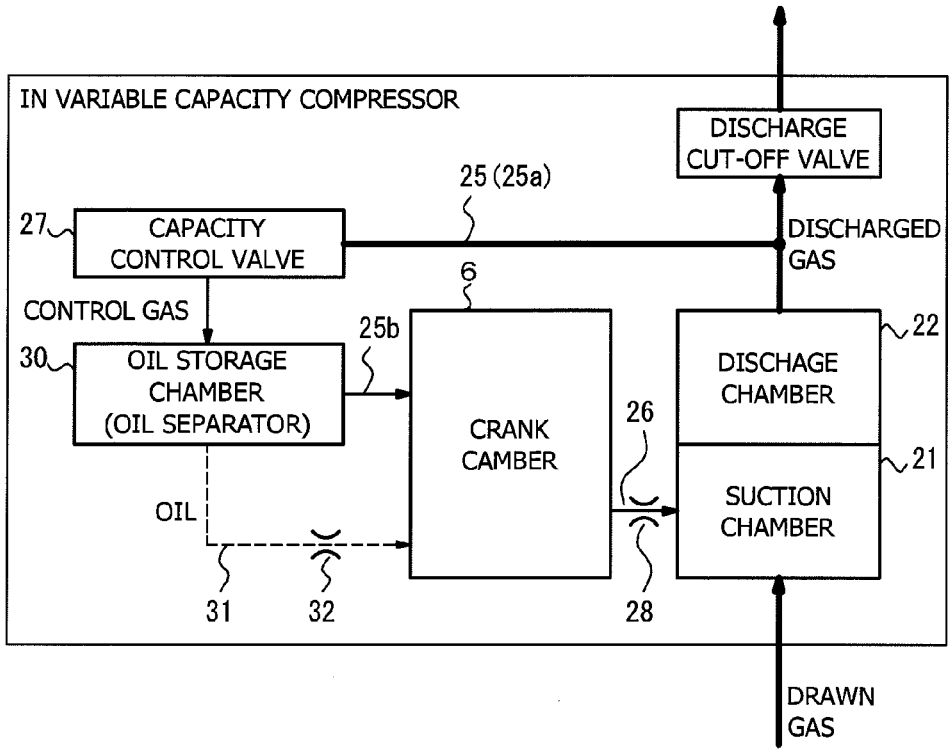
FIG. 3 is a schematic diagram illustrating passages of refrigerant, control gas, and lubrication oil in a compressor.

For this control, as illustrated in a schematic diagram of FIG. 3, a first communication passage 25 (25*a* and 25*b*) that allows the discharge chamber 22 and the crank chamber 6 to communicate with each other to allow some of discharged refrigerant gas in the discharge chamber 22 to flow into the crank chamber 6 and a second communication passage 26 that allows the crank chamber 6 and the suction chamber 21 to communicate with each other to return the refrigerant in the crank chamber 6 to the suction chamber 21 are provided, a capacity control valve 27 for controlling an opening degree thereof is mounted on the first communication passage 25, and an orifice 28 is mounted on the second communication passage 26.

Accordingly, a balance between an inflow amount of high-pressure refrigerant gas that flows into the crank chamber 6 through the first communication passage 25 (25*a* and 25*b*) and an outflow amount of refrigerant gas that flows out from the crank chamber 6 through the second communication passage 26 is controlled by adjusting the opening degree of the capacity control valve 27 to determine the pressure of the crank chamber 6.

As a result, a difference between the pressure of the crank chamber 6 and the pressure of the compression chamber 20 with the piston 15 interposed therebetween is changed to change an inclination angle of the swash plate 14 to the drive shaft 7. As a result, the stroke of the piston 15, that is, the discharge capacity of the compressor is changed.

For example, when the pressure of the crank chamber 6 is decreased, the inclination angle of the swash plate 14 is increased, and as a result, the discharge capacity of the compressor is increased. In contrast, when the pressure of the crank chamber 6 is increased, the inclination angle of the swash plate 14 is decreased, and as a result, the discharge capacity of the compressor is decreased.

Although an internal structure of the capacity control valve 27 is not illustrated, the capacity control valve 27 includes a solenoid capable of generating predetermined electromagnetic force in a valve closing direction and a bellows that extends in a valve opening direction by the decrease of the pressure in response to the pressure (suction pressure Ps) of the suction chamber 21, and opening and closing of the capacity control valve 27 is controlled according to the electromagnetic force and the suction pressure.

Herein, when predetermined current flows on the solenoid, actuation force in the valve closing direction is generated, and as a result, a valve body is closed. Therefore, communication between the discharge chamber 22 and the crank chamber 6 is interrupted. As a result, the gas of the discharge chamber 22 does not flow into the crank chamber 6 and a gas flow toward the suction chamber 21 from the crank chamber 6 through an orifice 28 is generated. As a result, the pressure of the crank chamber 6 is decreased to be equivalent to the pressure of the suction chamber 21, and the compressor is maintained at a maximum capacity and the pressure of the suction chamber 21 is gradually decreased.

When the pressure of the suction chamber 21 is decreased to a predetermined value, the bellows extends to be actuated in a direction in which the valve body is opened, and as a result, the gas of the discharge chamber 22 flows into the crank chamber 6 and the discharge capacity is decreased by the increase in pressure difference between the crank chamber 6 and the suction chamber 21. As a result, when the pressure of the suction chamber 21 is increased, the bellows is contracted to be actuated in a direction in which the valve body is closed, and as a result, the discharge capacity is increased by the decrease in pressure difference between the crank chamber 6 and the suction chamber 21.

Therefore, when the electromagnetic force is constant, the opening degree of the valve body is adjusted so that the suction pressure Ps becomes a predetermined value, and the discharge capacity is controlled.

Next, an OCR reduction technology in the embodiment will be described.

Referring to the schematic diagram of FIG. 3, an oil storage chamber 30 separating the lubrication oil in the control gas and storing the separated oil is formed by extending a downstream part of the capacity control valve 27 of the first communication passage 25 that allows the discharge chamber 22 and the crank chamber 6 to communicate with each other to allow some of the discharged refrigerant gas in the discharge chamber 22 to flow into the crank chamber 6.

The first communication passage 25 at a downstream side of the oil storage chamber 30 (25*b* illustrated) is formed toward the crank chamber 6 from the upper portion of the oil storage chamber 30.

Furthermore, an oil return passage 31 is formed toward the crank chamber 6 from the lower portion of the oil storage chamber 30, and an orifice 32 is provided on the oil return passage 31.

A detailed configuration is illustrated in FIGS. 1 and 2.

The capacity control valve 27 is mounted on the rear housing 4 in a horizontal direction. A downstream passage of an outlet 27*a* is largely extended downward to form the oil storage chamber 30. Reference numeral 33 in the drawing denotes a cover member that partitions the oil storage chamber 30 relative to the outlet 27*a*. Furthermore, the size of the oil storage chamber 30 may be equal to or greater than 15 $cm^3$ in order to acquire a sufficient separation effect.

In FIG. 1, as the first communication passage 25, a communication passage 25*a* from the discharge chamber 22 and a communication passage 25*b* to the crank chamber 6 (a space 34) are illustrated, and the control valve 27 is provided therebetween. As illustrated in FIG. 2, the communication passage 25*b* at the downstream side of the control valve 27 is formed toward the crank chamber 6 (space 34) from the upper portion of the oil storage chamber 30. Furthermore, the communication passage 25*b* is opened to the space 34 for inserting the drive shaft 7 in the cylinder block 1, and the space 34 communicates with the crank chamber 6 through a passage 35 and/or air gap of a bearing 8 of the drive shaft 7.

As illustrated in FIG. 1, the second communication passage 26 is provided on the valve plate 3 to allow the space 34 and the suction chamber 21 to communicate with each other, and the orifice 28 is provided herein.

As illustrated in FIGS. 1 and 2, the oil return passage 31 from the oil storage chamber 30 is formed around the bottom of the oil storage chamber 30 (at a position which is slightly higher than the bottom), and communicates with the crank chamber 6 through a through-hole 36 of the bolt 5 in the cylinder block 1 through the orifice 32.

In the embodiment, in the capacity control region, when the capacity control valve 27 is opened, some of the discharged refrigerant gas in the discharge chamber 22 flows into the crank chamber 6 (space 34) by passing through the first communication passage 25 (25*a* and 25*b*) as the control gas, while some of the refrigerant gas in the crank chamber 6 flows out to the suction chamber 21 by passing through the orifice 28 of the second communication passage 26, and the pressure of the crank chamber 6 is controlled by the balance between the inflow amount and the outflow amount to control the stroke of the piston 15, and as the pressure of the crank chamber 6 is increased, the stroke of the piston 15 is decreased.

Herein, a flow passage area is increased at once when the control gas flows out to the oil storage chamber 30 which is extended after passing through the capacity control valve 27 on the way of the first communication passage 25 (25*a* and 25*b*), and thus, a flow speed is decreased As a result, the lubrication oil contained in the control gas is separated by a difference in specific gravity. Furthermore, when the control gas is injected from the outlet 27*a* of the capacity control valve 27, the control gas collides with the cover member 33 that faces the outlet 27*a*, and as a result, the lubrication oil contained in the control gas is also separated. In addition, in order to further increase the separation effect, a baffle plate (not illustrated) may be installed in the oil storage chamber 30.

The control gas from which the lubrication oil is separated flows toward the crank chamber 6 (space 34) from the upper portion of the oil storage chamber 30 by passing through the communication passage 25*b*.

Furthermore, the lubrication oil separated from the control gas is stored on the bottom of the oil storage chamber 30.

Moreover, the stored lubrication oil is returned to the crank chamber 6 gradually by passing through the orifice 32 of the oil return passage 31, and is used to lubricate each unit in the crank chamber 6.

Accordingly, according to the embodiment, in the capacity control region (the region in which the refrigerant gas flows on the first communication passage 25 from the discharge chamber 22 to the crank chamber 6 as the control gas), oil may be separated from the control gas, while since the oil storage chamber (extension room) 30 for oil separation is provided on the passage of the control gas, efficiency deterioration may be suppressed.

Furthermore, since the oil storage chamber 30 is provided to store the separated oil at least temporarily, liquefaction is promoted after separation, and as a result, a time when the lubrication oil remains in the crank chamber 6 is increased, thereby enhancing lubricating performance of each unit.

Furthermore, according to the embodiment, the first communication passage 25 is formed toward the crank chamber 6 (space 34) from the upper portion of the oil storage chamber 30 at the downstream side of the oil storage chamber 30, and the oil return passage 31 is formed toward the crank chamber 6 from the lower portion of the oil storage chamber 30 to accurately guide the control gas and the lubrication oil without mixing the separated control gas (refrigerant) and the lubrication oil again.

In addition, according to the embodiment, the oil return passage 31 is configured to have the orifice 32 to secure a time when the oil remains in the storage chamber 30 by restricting an oil return amount, thereby promoting liquefaction after separation.

Figure 4:
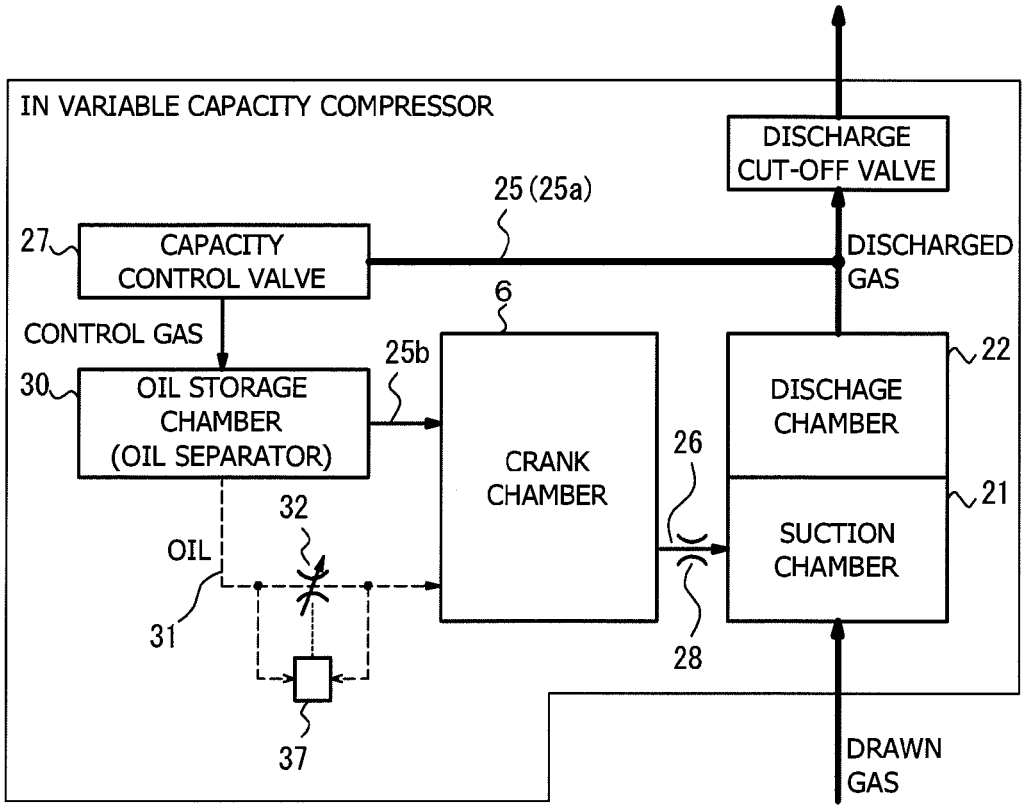
FIG. 4 is a schematic diagram illustrating another embodiment of the present invention.

Next, another embodiment of the present invention will be described with reference to a schematic diagram of FIG. 4. Furthermore, FIG. 4 indicates the elements identical or common to elements in FIG. 3 assigned the same reference numerals, and as a result, a description thereof will be omitted.

In the embodiment, as the orifice 32 provided in the oil return passage 31, a variable orifice is adopted, and in particular, the orifice 32 is actuated in a direction to reduce the diameter of the orifice with the increase of difference pressure before and behind the orifice 32 by a variable orifice mechanism 37. This is based on the following reason.

The orifice 32 of the oil return passage 31 restricts the oil return amount in order to keep the oil return amount to a constant and small flow rate, but when the pressure difference before and behind the orifice 32 is increased for any reason, the return amount is increased and the oil storage effect is reduced.

Therefore, when the pressure difference before and behind the orifice 32 is increased, the diameter of the orifice 32 is reduced by the variable orifice mechanism 37 to suppress an increase of the oil return amount by the pressure difference before and behind the orifice 32, and the oil storage effect is secured by keeping the oil return amount at a constant and small flow rate.

Accordingly, in particular, according to the embodiment, the oil storage effect is secured to enhance the lubricating performance regardless of the change of an operation condition.

Furthermore, in the embodiments described above, the oil storage chamber 30 is disposed in the rear housing (cylinder head) 4, but the oil storage chamber 30 may be disposed in the cylinder block 1.

In addition, the embodiments described above and illustrated in the figures are examples only of the present invention, and needless to say, the present invention includes one directly indicated by the explained embodiment, as well as various improvements and modifications, which is achieved by one skilled in the art within the scope of the appended claims.

REFERENCE SIGNS LIST

1 Cylinder block
1*a* Cylinder bore
2 Front housing
3 Valve plate
4 Rear housing
5 Bolt
6 Crank chamber
7 Drive shaft
8, 9 Bearing
10 Pulley
11 Rotor
12 Swash plate supporting body
13 Hinge mechanism
14 Swash plate
15 Piston
16 Shoe
20 Compression chamber
21 Suction chamber
22 Discharge chamber
23 Suction port
24 Discharge port
25(25*a*, 25*b*) First communication passage
26 Second communication passage
27 Capacity control valve
27*a* Outlet
28 Orifice
30 Oil storage chamber
31 Oil return passage
32 Orifice
33 Cover member
34 Space
35 Passage
36 Through-hole
37 Variable orifice mechanism

The invention claimed is:

1. A variable capacity compressor including a piston which compresses refrigerant gas containing lubrication oil drawn from a suction chamber to discharge the compressed refrigerant gas to a discharge chamber, a crank chamber disposed in the rear of the piston, a first communication passage which allows the discharge chamber and the crank chamber to communicate with each other, a second communication passage which allows the crank chamber and the suction chamber to communicate with each other, a control valve mounted on the first communication passage, and an orifice mounted on the second communication passage, in which a stroke of the piston is changed by controlling the pressure of the crank chamber with the control valve, the variable capacity compressor comprising:

an oil storage chamber extended at a downstream of the control valve on the first communication passage to separate oil and store the separated oil; and an oil return passage formed separately from the first communication passage running from the oil storage chamber to the crank chamber to return the oil stored in the oil storage chamber to the crank chamber.

2. The variable capacity compressor according to claim 1, wherein the first communication passage communicates the crank chamber with an upper portion of the oil storage chamber, and the oil return passage communicates the crank chamber with a lower portion of the oil storage chamber.

3. The variable capacity compressor according to claim 1, wherein the oil return passage has an orifice.

4. The variable capacity compressor according to claim 3, wherein the orifice of the oil return passage is a variable orifice.

5. The variable capacity compressor according to claim 4, wherein the variable orifice is actuated in a direction to reduce an orifice diameter in response to an increase in pressure difference before and behind the orifice.

* * * * *